United States Patent [19]

Wilson et al.

[11] 4,051,288

[45] Sept. 27, 1977

[54] METHOD OF PRODUCING REINFORCED SHEET MATERIAL

[76] Inventors: Alister Wilson, Kilmory, Rosebank Lane; William David Marr, 13 Pitreuchie Place, both of Forfar, Angus; George Arthur Guild, 2 Golf Road, Kirriemuir, Angus, DD8 4PY, all of Scotland

[21] Appl. No.: 688,305

[22] Filed: May 20, 1976

[30] Foreign Application Priority Data

May 21, 1975 United Kingdom ..... 21762/75

[51] Int. Cl.[2] ..... B32B 31/12

[52] U.S. Cl. ..... 428/102; 66/85 A; 112/262; 112/432; 156/82; 156/93; 428/294; 428/300; 428/310; 28/108; 28/112

[58] Field of Search ..... 28/72.2 R, 77; 66/85 A; 156/93, 82, 148; 112/432, 262; 428/294, 295, 310, 300, 102

[56] References Cited

U.S. PATENT DOCUMENTS

| | | | |
|---|---|---|---|
| 3,327,501 | 6/1967 | Bahlo | 66/85 A |
| 3,442,101 | 5/1969 | Ploch et al. | 66/85 A |
| 3,451,885 | 6/1969 | Klein | 28/72.2 R |
| 3,793,414 | 2/1974 | Buff et al. | 28/72.2 R |

*Primary Examiner*—Edward G. Whitby

[57] ABSTRACT

A method of producing a reinforced sheet by feeding a layer of foam material to a stitching machine at a rate greater than that at which the stitched material is produced by the machine. The stitching in the product is thus disposed below the surface of the foam and hence is not destroyed during subsequent flame-bonding.

8 Claims, 1 Drawing Figure

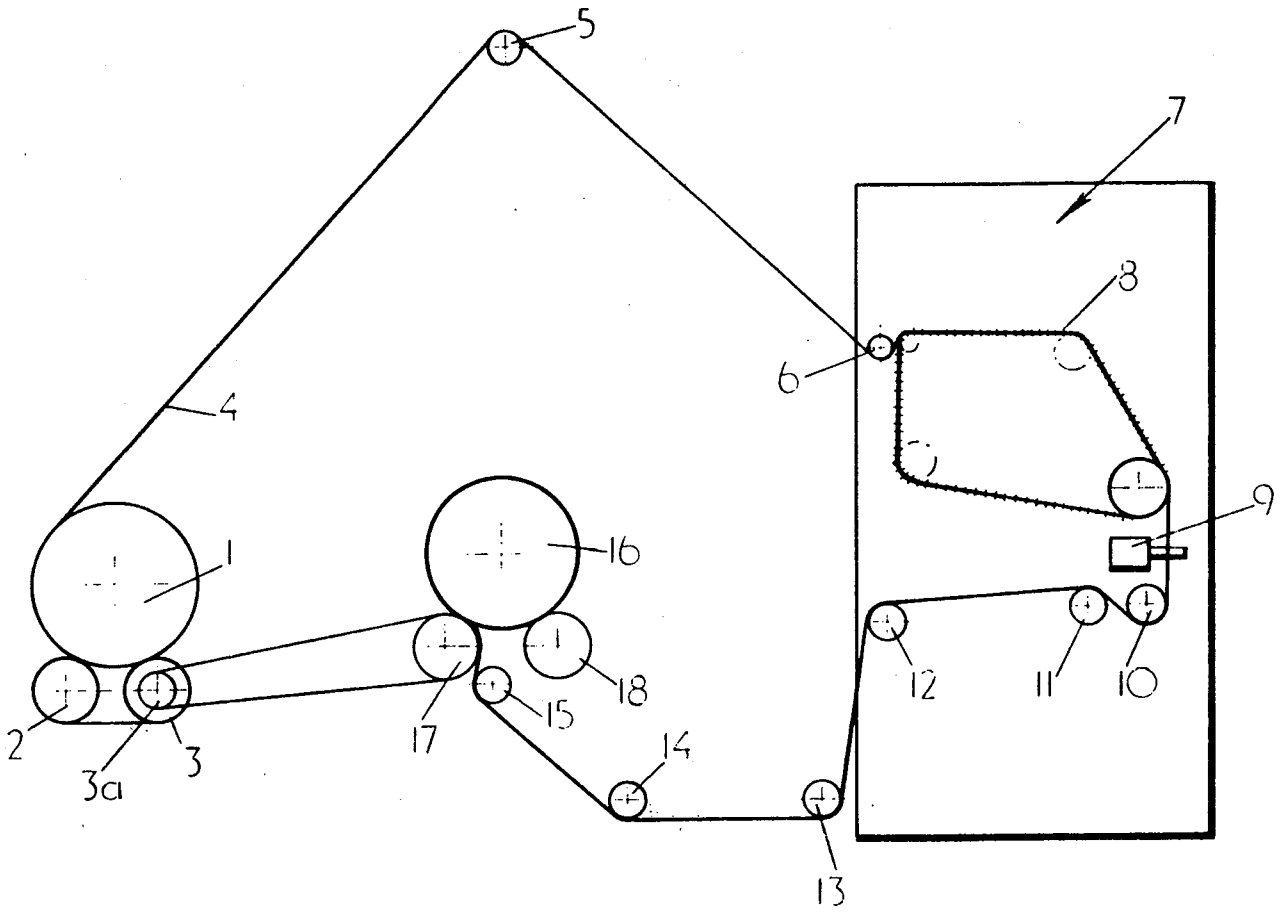
7
8
9
10
11
12
13
6
5
14
16
18
15
17
4
1
3
3a
2

METHOD OF PRODUCING REINFORCED SHEET MATERIAL

FIELD OF THE INVENTION

This invention relates to a method of producing a reinforced sheet comprising a layer of material reinforced with a system of substantially non-extensible yarn stitched into the material.

STATE OF THE ART

Such a reinforced sheet of elastomeric foam, e.g. polyurethane has previously been proposed and which is subsequently treated by applying to at least one face a thin polymeric film to form an external surface for the sheet. During the reinforcing of such sheets the foam layer is fed to a machine in which the reinforcing stitching is applied and during the stitching process, the foam material is held in a slightly stretched condition and subsequently allowed to contract again. This has the effect that the stitching tends to project upwardly from, or at least lie in a plane which is level with the surface of the foam material.

The fact that the stitching is exposed in this manner is a serious disadvantage when it comes to applying a surface layer to the reinforced sheet material as by flame-bonding.

In the flame-bonding process, a flame is applied briefly to the surface of the foam material to melt the foam and the surface layer is then applied to the melted foam to allow the layer to fuse to the foam. If the reinforcing stitching is disposed at or above the surface of the foam material during the flame treatment, the flame has ready access to the stitching and tends to destroy the reinforcement.

SUMMARY OF THE INVENTION

An object of the present invention is to provide a method of producing reinforced sheet material in which the aforesaid disadvantages are obviated or mitigated.

According to the present invention there is provided a method of producing a reinforced sheet incorporating a layer of material reinforced with a stitched system of substantially non-extensible yarn, said method comprising feeding a layer of foam material to a stitching machine at a feed rate greater than the rate at which the stitched material is produced by said stitching machine.

DESCRIPTION OF THE DRAWINGS

A preferred embodiment of the invention will now be described, though by way of illustration only, with reference to the accompanying FIGURE, which shows a schematic side elevation of the apparatus used in the preferred method of the invention.

DESCRIPTION OF THE PREFERRED EMBODIMENT

In the FIGURE, a driven foam input roll 1 is driven by drive rollers 2 and 3 and feeds a web 4 of polyurethane foam material over two guide rollers 5 and 6 to a conventional stitch bonding machine (generally designated 7). After passing the roller 6 the web of material passes horizontally on to the pins of a pinned feed carrier 8 and thence to a stitching head 9 where the web 4 of polyurethane has applied thereto in known manner a stitched reinforcement comprising a plurality of rows of tricot or chain stitches.

After passing through the stitching head 9, the web 4 passes between two carborundam-covered rollers 10 and 11 and thence over four guide rollers 12, 13, 14, and 15 and is then taken up by a take-up roll 16. Roll 16 is generally similar to the input roll 1, being driven by two drive rollers 17 and 18 which are 10% larger in diameter than a drive pulley 3*a* on the roller 3 of the input roll 1. An endless belt passes around the pulley 3a and the roller 17, thus ensuring that the rate at which the web is fed from the input roll 1 is 10% greater than that at which the finished material is taken up by the roll 16. Also, the pinned feed carrier is driven at a speed 10% faster than that at which the finished material is taken away by the roll 16. In this way, excess of approximately 10% of foam material is fed to the stitching head at any instant and it has been found that when the stitched web is taken from the machine the stitching threads lie below the surface of the foam material. By this means a stitched reinforced material is produced in which the foam material lies above the level of the stitching.

A polymeric film can then be applied to the stitched reinforced foam material either by transfer coating or by flame-bonding.

In the case of transfer coating, it will be understood that a satisfactory adhesive bond can be achieved readily between the film and the surface of the foam which stands above the reinforcing stitching. This prevents the profile of the yarn from appearing in the finished surface.

In the case of flame-bonding, a flame can be applied to a surface of the reinforced foam material and, as the stitching is embedded below the surface of the foam, the stitching will be protected from the application of the flame. In this way the stitching will tend not to be destroyed or weakened as is the case with materials in which the stitching stands is at or above the surface of the foam material.

Although one arrangement for producing a stitched, reinforced foam material has been described above, it will be appreciated that the mechanism employed can be varied as desired, so long as the basic principle is maintained, i.e. there is an overfeed of the foam material brought about by the foam material being fed to the stitching machine at a feed rate greater than this rate at which the stitched material is produced by the stitching machine. Clearly, the machine can be arranged in a novel manner to ensure the "overfeed" condition as by suitable gearing or other control means.

What is claimed is:

1. In a method of producing a reinforced sheet of a foam material comprising a layer of a foam material reinforced with a stitched system of substantially non-extensible yarn disposed generally parallel to the surface of the foam material which method includes feeding a layer of foam material through a stitching machine and thereby incorporating the reinforced stitching in the foam material, the improvement comprising feeding the foam material to the stitching machine at a rate greater than that at which the stitched system of reinforcing is produced by the machine.

2. A method according to claim 1, wherein the rate at which the foam material is fed to the stitching machine is substantially 10% greater than that at which the stitched system of reinforcing is produced by the machine.

3. A reinforced sheet produced by a method according to claim 1.

4. A method according to claim 1, wherein the foam material is a sheet of polymeric elastomeric material.

5. A method according to claim 4, wherein the foam material is polyurethane.

6. A method according to claim 1, including applying to the surface of the reinforced foam layer a relatively thin polymeric film.

7. A method according to claim 6, wherein the thin polymeric film is applied by flame-bonding.

8. A reinforced sheet produced by a method according to claim 7.

* * * * *